United States Patent [19]

Bozek

[11] 3,933,270

[45] Jan. 20, 1976

[54] CLOSURE WITH PROTECTIVE INSERT

[75] Inventor: John S. Bozek, Chicago, Ill.

[73] Assignee: Continental Can Company, Inc., New York, N.Y.

[22] Filed: Jan. 27, 1975

[21] Appl. No.: 544,152

[52] U.S. Cl. ..... 220/270

[51] Int. Cl.[2] ..... B65D 41/32

[58] Field of Search ..... 220/269, 270–274, 220/277, 90.6

[56] References Cited

UNITED STATES PATENTS

| | | | |
|---|---|---|---|
| 3,765,561 | 10/1973 | Hekal et al. | 220/270 |
| 3,813,000 | 5/1974 | Underwood | 220/269 |

*Primary Examiner*—George T. Hall

*Attorney, Agent, or Firm*—John J. Kowalik; Joseph E. Kerwin; William A. Dittmann

[57] ABSTRACT

A standard easy-open closure is converted to a child-resistant safety closure by the addition of an insert which is mounted on the rivet between the end panel and the tab. The insert extends beneath the piercing member and prevents cracking of the end panel score. The tab must be depressed, thereby allowing the insert to be rotated from beneath the piercing member, before the closure may be removed. These two additional operations, which must be performed in proper sequence, render removal of the closure beyond the capability of the young child.

10 Claims, 3 Drawing Figures

CLOSURE WITH PROTECTIVE INSERT

SUMMARY OF THE INVENTION

It is well known that the accumulation of medicines and household chemicals commonly found in the home poses the threat of death or serious injury to small children. Storage of these materials in places supposedly beyond the reach of such children has not proven wholly satisfactory. It is, therefore, one of the important objects of the present invention to provide an improved safety or security closure for a standard easy-open container which may be readily removed by an adult but which will resist the efforts of small children to obtain access to the contents of the container.

It is a further object to provide an improved security closure wherein the standard easy-open closure may be employed with a minimum of modification thereto; and more particularly it is an object to provide a protective insert member that may be combined with such an easy-open closure to provide a security closure.

It is another object to provide an improved security closure that provides the adult user with visual clues as to its method of operation while retaining its child-resistant features.

BRIEF DESCRIPTION OF THE DRAWINGS

The various features and advantages of the security closure of this invention will be more apparent from the following detailed description when considered in connection with the accompanying drawing wherein.

DESCRIPTION OF THE PREFERRED EMBODIMENT

Figure 1:
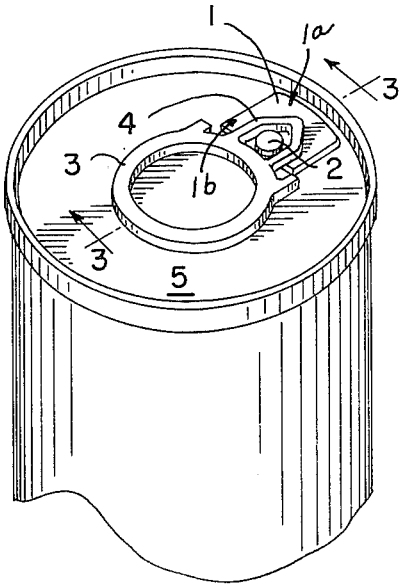
FIG. 1 is a perspective view of the upper portion of a container having in association therewith a closure device representative of the present invention, illustrating the insert in the protective position.
Figure 2:
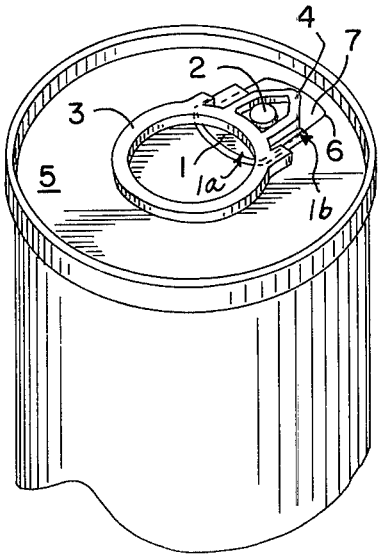
FIG. 2 is a view similar to FIG. 1, wherein the insert is in the withdrawn position.
Figure 3:
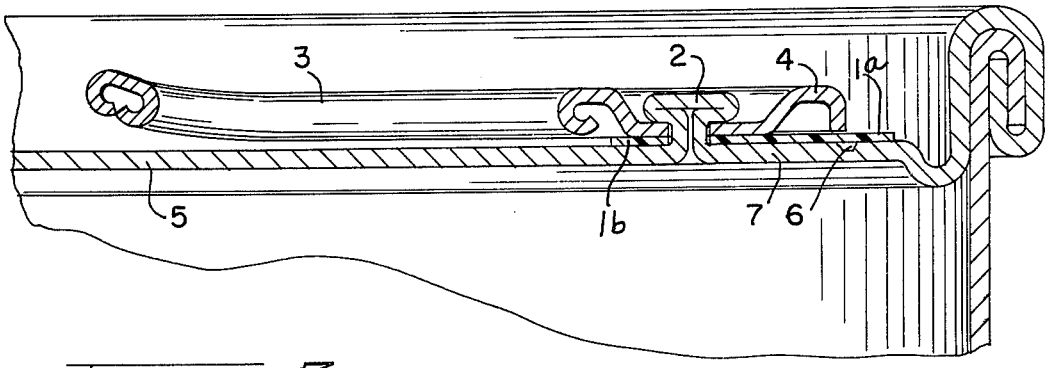
FIG. 3 is a fragmentary sectional view taken generally along line 3—3 of FIG. 1.

As shown in the drawings, the security closure of this invention includes an end panel 5, a tab ring 3 with integral piercing member 4, a rivet 2 fastening said tab ring 3 to said end panel 5, a score line 6 formed in said end panel 5 and therein defining an opening flap 7, and a protective insert 1 rotatably mounted on said rivet 2 between said tab ring 3 and said end panel 5.

The insert 1 is mounted with a longer portion 1*a* on one side of the rivet 2 and a shorter portion 16 on the other side of the rivet 2, the longer portion 1*a* having sufficient length to overlie the score line 6 and width exceeding that of the piercing member 4, the shorter portion 16 having insufficient length to overlie the score line 6. The insert 1 is formed of a stiff material, preferably a plastic such as polyethylene.

In the standard easy-open closure, which lacks a protective insert 1, opening is accomplished by vertically displacing the tab ring 3, thereby pivoting said tab ring 3 about the rivet 2 and impressing a downward force on the piercing member 4, said force resulting in the bursting of the end panel 5 along the score line 6 beneath said piercing means 4. Continued upward displacement of said tab ring 3 results in controlled tearing of said end panel 5 along said score line 6. The opening flap 7 defined by said score line 6 is then removed by pulling the tab ring 3 thereby causing further tearing along the score line 6 until the opening flap 7 separates from the remainder of the end panel 5.

In the security closure of this invention, a protective insert 1 is provided which shields the score line 6 beneath the piercing member 4, thereby preventing cracking of said score line 6 and the consequent opening of the end closure. To open the safety closure, the end of tab ring 3 remote from piercing member 4, must first be depressed, thereby allowing rotation of the protective insert 1 to the withdrawn position, the closure is opened in the conventional manner as described hereinabove.

Although the presence of the protective insert 1 provides the adult user with a visual clue as to the method of operation of the security closure, its import is beyond the comprehension of a small child. Further, depression of the tab ring 3 as initially required to allow rotation of the protective insert 1, runs counter to the experience of a child. Finally, the additional operations required to open the safety closure are beyond the memory and the manual dexterity capability of the child.

I claim:

1. An improved safety closure for use on a can or similar container comprising an end panel having a score defining an opening flap therein, a pull tab secured to said end panel and having means for fracturing said score to open said flap, and protective means for shielding said score from said fracturing means.

2. An improved safety closure as defined in claim 1, wherein said protective means is positionable in covering relation to the score and moveable to expose said score line incident to opening of the container.

3. An improved safety closure as defined in claim 2, wherein said protective means comprises a substantially rigid insert.

4. An improved safety closure as defined in claim 3, wherein said pull tab is secured to said end panel by a rivet and said insert is rotatably mounted on said rivet between said end panel and said pull tab.

5. An improved safety closure as defined in claim 4, wherein the end of said pull tab remote from said fracturing means must be displaced panelwardly to allow rotation of said insert.

6. An improved safety closure as defined in claim 5, wherein said insert is formed of plastic.

7. An improved safety closure as defined in claim 1, wherein said protective means comprises an insert movably mounted between said tab and said end panel, said insert being wider than said fracturing means.

8. An improved safety closure as described in claim 4, wherein said insert has a longer portion on one side of said rivet than on the other side.

9. An improved safety closure as defined in claim 1, wherein said protective means straddles said score.

10. An improved safety closure as defined in claim 6, wherein said insert is formed of polyethylene.

* * * * *